US008061783B2

(12) United States Patent
Keller et al.

(10) Patent No.: US 8,061,783 B2
(45) Date of Patent: Nov. 22, 2011

(54) BIT HOLDER BLOCK WITH NON-ROTATING WEAR SLEEVE

(75) Inventors: Donald E. Keller, Bedford, PA (US); Don C. Rowlett, Bedford, PA (US)

(73) Assignee: Kennametal Inc., Latrobe, PA (US)

( * ) Notice: Subject to any disclaimer, the term of this patent is extended or adjusted under 35 U.S.C. 154(b) by 236 days.

(21) Appl. No.: 12/191,449

(22) Filed: Aug. 14, 2008

(65) Prior Publication Data

US 2010/0038955 A1 Feb. 18, 2010

(51) Int. Cl.
*E21C 35/197* (2006.01)
*E21C 35/19* (2006.01)

(52) U.S. Cl. ..... 299/102

(58) Field of Classification Search ..... 299/102–104, 299/106–107, 110
See application file for complete search history.

(56) References Cited

U.S. PATENT DOCUMENTS

| | | | |
|---|---|---|---|
| 3,397,012 | A | 8/1968 | Krekeler |
| 3,498,677 | A | 3/1970 | Morrow |
| 3,519,309 | A | 7/1970 | Engle et al. |
| 3,652,130 | A | 3/1972 | Elders |
| 3,841,708 | A | 10/1974 | Kniff et al. |
| 4,201,421 | A | 5/1980 | Den Besten et al. |
| 4,462,638 | A | 7/1984 | Den Besten |
| 4,484,783 | A | 11/1984 | Emmerich |
| 4,650,254 | A | 3/1987 | Wechner |
| 5,011,229 | A | 4/1991 | O'Neill et al. |
| 5,106,166 | A | 4/1992 | O'Neill |
| 5,273,343 | A | 12/1993 | Ojanen |
| 5,303,984 | A | 4/1994 | Ojanen |
| 5,503,463 | A | 4/1996 | Ojanen |
| 5,628,549 | A | 5/1997 | Ritchey et al. |
| 5,730,502 | A | 3/1998 | Montgomery, Jr. |
| 6,364,420 | B1 | 4/2002 | Sollami |
| 6,371,567 | B1 | 4/2002 | Sollami |
| 6,508,516 | B1 | 1/2003 | Kammerer |
| 6,685,273 | B1 | 2/2004 | Sollami |
| 6,786,557 | B2 | 9/2004 | Montgomery, Jr. |
| 6,854,810 | B2 | 2/2005 | Montgomery, Jr. |
| 6,962,395 | B2 | 11/2005 | Mouthaan |
| 7,270,379 | B2 | 9/2007 | Stehney |
| 7,300,114 | B2 | 11/2007 | Frear |
| 7,380,889 | B2 | 6/2008 | Frear |
| 2002/0074851 | A1 | 6/2002 | Montgomery, Jr. |
| 2002/0153175 | A1 | 10/2002 | Ojanen |
| 2003/0015907 | A1 * | 1/2003 | Sollami ..... 299/104 |
| 2004/0051370 | A1 | 3/2004 | Montgomery, Jr. |
| 2007/0013224 | A1 | 1/2007 | Stehney |

FOREIGN PATENT DOCUMENTS

| | | | |
|---|---|---|---|
| EP | 1033216 | A1 | 9/2000 |
| GB | 2182373 | A | 5/1987 |

* cited by examiner

*Primary Examiner* — Sunil Singh
(74) *Attorney, Agent, or Firm* — Matthew W. Smith

(57) ABSTRACT

A block and non-rotating wear sleeve for holding a cutting tool used with mining and construction is disclosed. A key is used to intersect with notches in the wear sleeve and block at a rear face of the wear sleeve and block to prevent rotational movement between the wear sleeve and block. Locating the key and notches at the rear face provides an easily manufactured anti-rotation means which is also sheltered from the most of the abrasion experienced by the block and wear sleeve.

10 Claims, 8 Drawing Sheets

BIT HOLDER BLOCK WITH NON-ROTATING WEAR SLEEVE

FIELD OF THE INVENTION

The present invention relates to tools and tool assemblies for mining and construction, more particularly, is concerned with retention of wear sleeves within a bit holder of the tool assembly.

BACKGROUND INFORMATION

Rotatable cutting tools are used in conjunction with a machine used to break up (or cut) a substrate such as coal, rock, asphalt pavement, asphaltic concrete, concrete or the like. In its very basic aspects, such a machine includes a driven member (e.g., a chain, a wheel or a drum), a holder either directly or indirectly mounted to the driven member, and a rotatable cutting tool rotatably held in the holder. It is the cutting tool that impinges the earth strata so as to break it into pieces and chunks upon impact.

Rotatable cutting tools and the holders operate in a high wear environment. These components inevitably fail due to the severity of the operating conditions; e.g. gritty, dusty and highly abrasive. While it is expected that the cutting tools experience wear, the ability of the cutting tool to rotate about its central longitudinal axis during operation generally prolongs the useful life of the cutting tool. Rotation promotes more even wear about the tool. It can thus be appreciated that features of the cutting tool or cutting tool assembly that facilitate the rotation of the cutting tool during operation are beneficial to the operation of the cutting tool (and cutting tool assembly) and the overall operation of the cutting machine.

As known to those skilled in the art, the useful life of the holder is much longer than the useful life of the cutting tool. A holder is often referred to as a part of a block. Accordingly, the term "holder" refers herein to a portion of a block or a block which holds a cutting bit. Each block is intended to accommodate many changes of cutting tools before the block must be changed. In order to reduce the wear on the forward face of the block and fretting between the block and the cutting bit, a wear sleeve may be used in conjunction with cutting tool and holder. The wear sleeve generally has a forward portion and shank and is positioned between the cutting tool and holder. The wear sleeve protects the block from wear and is removably mounted in the holder.

Although it is beneficial to promote rotation of the cutting tool, rotation of the wear sleeve in the bit holder is not desirable. As dust and/or debris works in between the bit holder and the wear sleeve, rotation of the wear sleeve encourages abrasion between the bit holder and the wear sleeve.

One such cutting tool that teaches a protective wear sleeve is shown and described in U.S. Pat. No. 7,270,379 to Stehney. Stehney '379 teaches a sleeve mounted in a holder block which utilizes a stepped configuration on the shank of the sleeve to create an interference fit between the holder block and the sleeve. The interference fit retains the sleeve within the holder block and prevents rotation within the sleeve of the holder block.

Another cutting tool that uses a protective wear sleeve is shown and described in U.S. Pat. No. 5,106,166 to O'Neill. O'Neill '166 teaches a wear sleeve with an index pin between the collar of the wear sleeve and the forward face of the block. O'Neill '166 also prevents rotation of the wear sleeve by utilizing a pin through an aperture through a shank of the block. The pin passes through the block and contacts a flat surface machined into the wear sleeve. In another embodiment, O'Neill '166 teaches non-rotation of the wear sleeve by using a hexagonally-shaped sleeve shank and block bore.

U.S. Pat. No. 5,273,343 to Ojanen teaches a non-rotatable wear sleeve. Ojanen '343 describes a wear sleeve for mounting a cutting tool in a bit holder. The deformed sleeve has one end shaped as an ellipse. The deformed sleeve is then force fit into a bore in the block and is retained therein in a non-rotating manner by friction. U.S. Pat. No. 5,303,984 to Ojanen teaches a non-rotatable sleeve for use in a block. Ojanen '984 teaches a diametrically compressible sleeve mounted in the bore of the block. The sleeve has an axial slot which allows it to be compressed from a diameter larger than the given diameter before insertion into a bore of the block and a compressed diameter substantially matching the given diameter after insertion into the bore of the block.

Numerous other teachings disclose similar devices and methods. Each teaching suffers from one or more of the following deficiencies. The wear sleeves must be replaced regularly as they wear out so convenient installation and extraction is important. However, the protective sleeve must also be secured in the bit holder so as not to be knocked loose by loads and torques that occur during normal operation of the cutting machine.

Another cutting tool that uses a protective member is shown and described in U.S. Pat. No. 6,508,516 B1 to Kammerer. The '516 Patent discloses a ring that includes a tab. The tab engages grooves in a holder so that the ring does not rotate relative to the holder. At the beginning of a milling cycle, the structure disclosed in U.S. Pat. No. 6,508,516 to Kammerer would be expected to provide a non-rotatable ring; however, over time the structure may be susceptible to problems. One such problem is that the groove that engages the tab may become clogged with debris. Obviously, this condition could compromise the integrity of the connection between the tab and the groove and result in the loss of the non-rotatable feature of the ring. Another problem is that over the course of operation the tab is exposed along the side of the tool so as to be susceptible to wearing away. The erosion of the tab could compromise the integrity of the connection between the tab and the groove and result in the loss of the non-rotatable feature of the ring.

The present invention has been developed in view of the foregoing.

SUMMARY OF THE INVENTION

The present invention provides a block and non-rotating wear sleeve for holding a cutting tool used with mining and construction equipment. A key is used to intersect with notches in the wear sleeve and block at a rear face of the wear sleeve and block to prevent rotational movement between the components. Locating the key and notches at the rear face provides and easily manufactured anti-rotation means which is also sheltered from the most of the abrasion experienced by the block and wear sleeve.

An aspect of the present invention provides an apparatus for mounting a cutting tool used in mining and construction, comprising a block comprising a holder portion having an interior surface defining a bore disposed about a longitudinal axis and passing through the holder portion, the bore extending from front face of the holder portion to a rear face of the holder portion, and at least one slot in the rear face of the holder portion; a wear sleeve having a forward portion adjacent the front face of the holder portion and a shank extending through the bore of the holder portion, the shank having a rear end with at least one notch therein; at least one key engaging the at least one slot of the holder portion and the at least one notch of the shank of the wear sleeve, thereby preventing rotational movement of the wear sleeve relative to the holder portion; and means for retaining the wear sleeve in the holder portion.

Another aspect of the present invention provides a wear sleeve for use in a mining, road working or earth moving cutting tool, the wear sleeve comprising a generally cylindrical shank disposed about a longitudinal axis having an exterior surface, a rear end and a forward end; a forward portion attached to the forward end of the shank, the forward portion having a shoulder which transitions from a first diameter corresponding to the exterior of the shank to a second larger diameter and a taper front surface; an inner surface defining a bore disposed about the longitudinal axis and extending axially through the forward portion and shank; at least one notch in the rear end of the shank; and a circumferential groove within the exterior surface of the shank which intersects the notch at the rear end of the shank.

Yet another aspect of the present invention provides an apparatus for mounting a cutting tool used in mining and construction, comprising a block comprising a holder portion having an interior surface defining a bore disposed about a longitudinal axis and passing through the holder portion, the bore extending from front face of the holder portion to a rear face of the holder portion; a wear sleeve having a forward portion adjacent the front face of the holder portion and a shank extending through the bore of the holder portion, the shank having a rear end; means for preventing rotation of the wear sleeve within the holder portion, wherein the means for preventing rotation is integrated into the rear face of the holder portion and the rear end of the shank of the wear sleeve; and means for retaining the wear sleeve in the holder portion.

These and other aspects will become more apparent from the following description.

DETAILED DESCRIPTION

For purposes of the following detailed description, it is to be understood that the invention may assume various alternative variations and step sequences, except where expressly specified to the contrary. In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

As used herein, the terms "channel", "slot" and "notch" are similarly defined as an indentation in a surface and may include not only depressions in a surface but also slots defined by raised portions of the surface. The use of the terms "channel", "slot" and "notch" within this specification is intended to instructive as to location of the element, e.g., at the wear sleeve or at the holder portion within an embodiment and is not intended to limit the terms beyond the definition given above.

Figure 1:
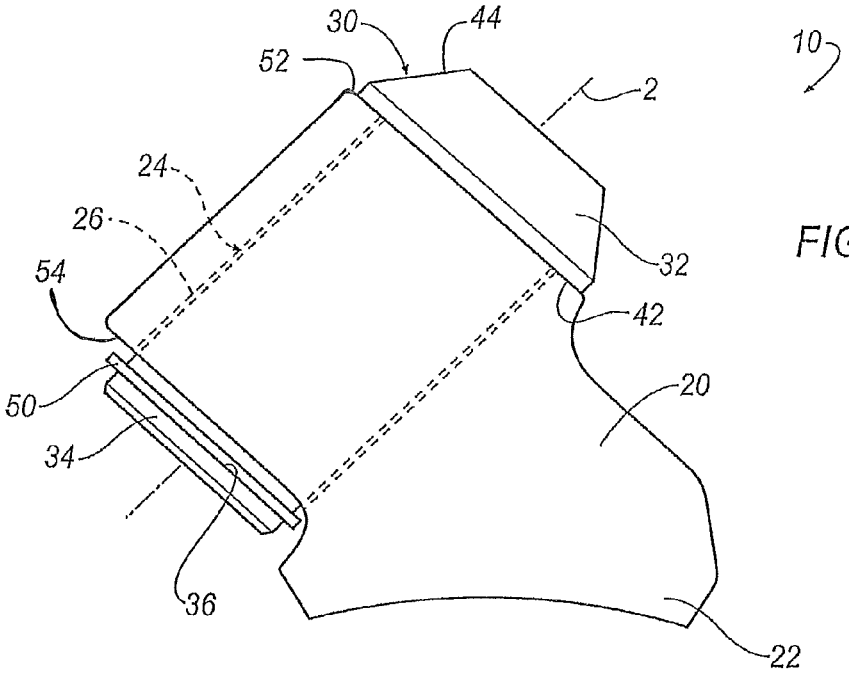
FIG. 1 is a side view of a base assembly including a block and wear sleeve according to one embodiment of the present invention.

Referring now to FIG. 1, a base assembly 10 is shown. The base assembly 10 includes a block 20 which mounts onto a rotating drum or other piece of equipment (not shown). The block 20 will often include a pedestal portion 22 and holder portion 24. The pedestal portion 22 is configured to allow the block 20 to be attached to the drum or other piece of equipment. In the embodiment shown in FIG. 1, the pedestal portion 22 has a curved bottom congruent to the shape of a drum exterior. The congruent shape allows the pedestal portion 22 to be easily welded onto the drum. The holder portion 24 includes a front face 52 and a rear face 54. The holder portion 24 portion of the block 20 has a bore 26 between the front face 52 and the rear face 54. The bore 26 allows the shank 34 of a wear sleeve 30 to be inserted into the holder portion 24. The bore 26 and wear sleeve 30 are generally disposed about a central longitudinal axis 2. The wear sleeve 30 also has a forward portion 32. The forward portion 32 often has a shoulder 42 which transitions from a first diameter of a shank 34 of the wear sleeve 30 to a second, larger diameter of the forward portion 32. The forward portion 32 may also have a tapered front surface 44. The wear sleeve 30 is structured and arranged to accept a cutting tool (not shown) having a shank which fits inside the wear sleeve 30 and a forward tip made from hard materials such as cemented tungsten carbide, polycrystalline diamond or other suitable material. The rear portion of the shank 34 of the wear sleeve projects axially from the bore 26. The portion of the shank 34 of the wear sleeve 30 which projects from the holder portion 24 includes a circumferential groove about the shank 34. One or more retaining rings 50 are fitted into the circumferential groove 36 to hold the wear sleeve 30 within the bore 26. Although the configuration of a circumferential groove and retaining ring is shown in this particular embodiment, other configurations are possible, such as various types of radial projections or recesses on the holder portion 24 or wear sleeve, press fits snap fits, mechanical fasteners and the like.

Figure 2:
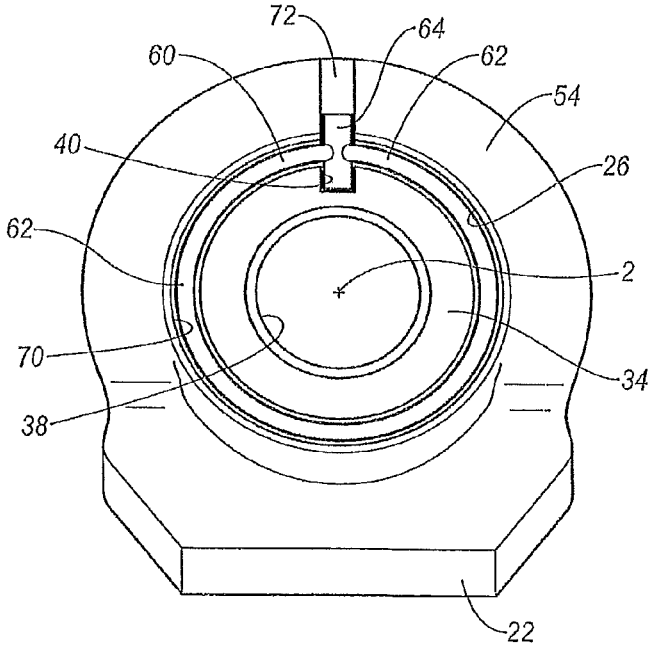
FIG. 2 rear view (from left in FIG. 1) along the longitudinal axis of the base assembly of FIG. 1 showing a keyed ring for preventing rotation of the wear sleeve according to one embodiment of the present invention.

Referring now to FIG. 2, a rear view of the base assembly 10 is shown. The retaining rings are not shown in this figure to allow a clearer description of other components of the base assembly 10. As noted above, the shank 34 of the wear sleeve 30 is inserted into the bore 26. The bore 26 has a counter bore 70 in the rear face 54 of the holder portion 24. Also, shaped into the rear face 54 is a radial slot 72. An axial slot 40 is defined in the rear section of the shank 34 of the wear sleeve 30. The axial slot 40 corresponds to the radial slot 72 of the holder portion 24. A keyed ring 60 comprises a ring section 62 and key section 64. The keyed ring 60 is sized to slide axially over the shank 34 of the wear sleeve 30 and into the recess created by the shank 34 and the counter bore 70. As seen in FIG. 2, the keyed portion 64 extends radially outward into the radial slot 72 of the holder portion 24. The keyed portion 64 also extends radially inward into the axial slot 40 of the shank 34 of the wear sleeve 30. This configuration interlocks the shank 34 with the holder portion 24 and prevents rotational movement of the wear sleeve 30.

Placing the keyed ring 60 at the rear face 54 of the holder portion 24 keeps it in a protected location away from the more severe abrasive effects at the front of the wear sleeve 30 and holder portion 24. In contrast, prior art, non-rotational means at the forward portion of the wear sleeve 30 and holder portion 24 are prone to failure before the wear sleeve 30. The keyed ring 60 and slots 40, 72 also provide an easily fabricated base assembly 10. Earlier designs utilizing press fits, interference fits or other means inside the bore 26 are difficult and expensive to machine. In contrast, the slots 40, 72 and keyed ring 60 are easily fabricated.

Figure 3:
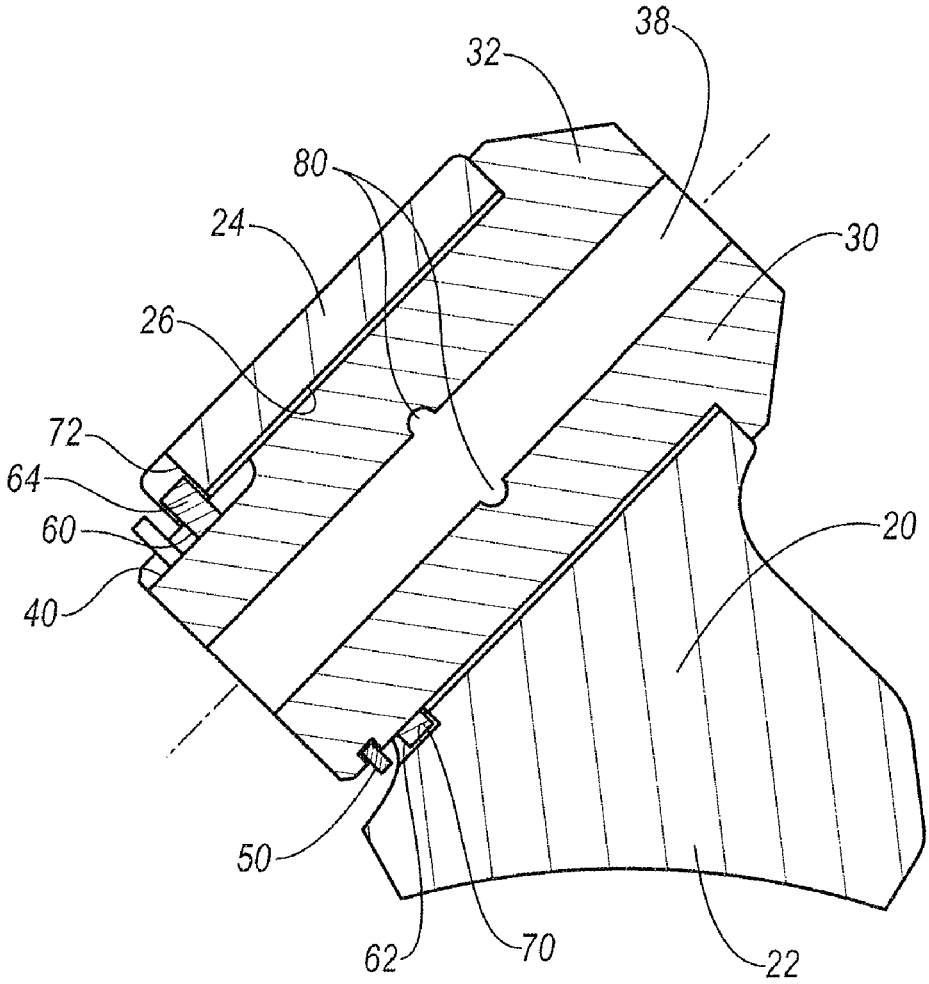
FIG. 3 is a cross section of the base assembly shown in FIG. 1 according to one embodiment of the present invention.

FIG. 3 is a cross-section of the block assembly 10 shown in FIGS. 1 and 2. The sleeve bore 38 may have a recess 80 for retaining the cutting tool (not shown). The keyed ring 60 may fit wholly or partially in counterbore 70. The key 64 extends from the radial slot 72 of the holder portion 24 into the axial slot 40 of the shank 34.

Figure 4:
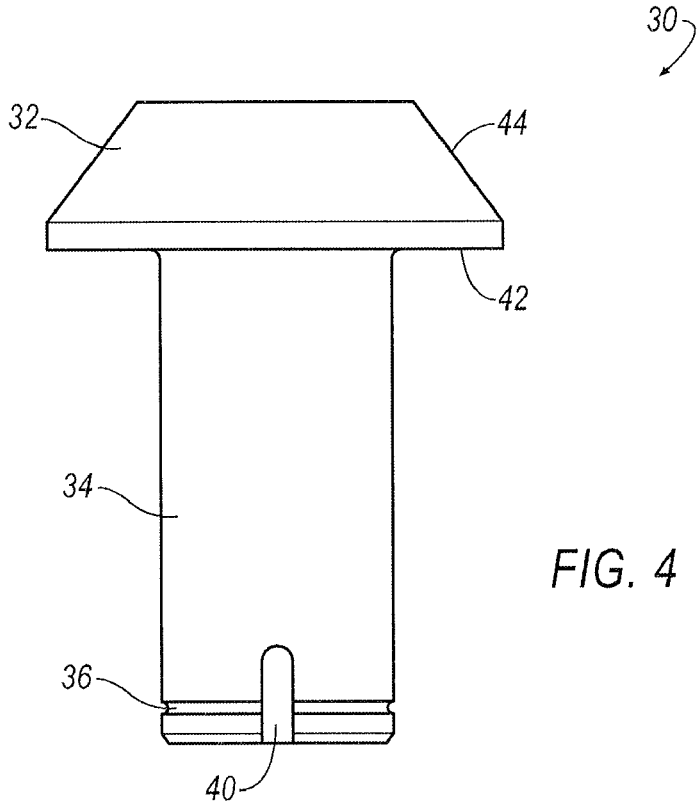
FIG. 4 is a side view of a wear sleeve according to one embodiment of the present invention.

Referring now to FIG. 4, a side view of the wear sleeve 30 is shown according to one embodiment of the present invention. Although the forward portion 32 shows a tapered front surface 44 and shoulder 42, other configurations known to those skilled in the art are possible.

Figure 5:
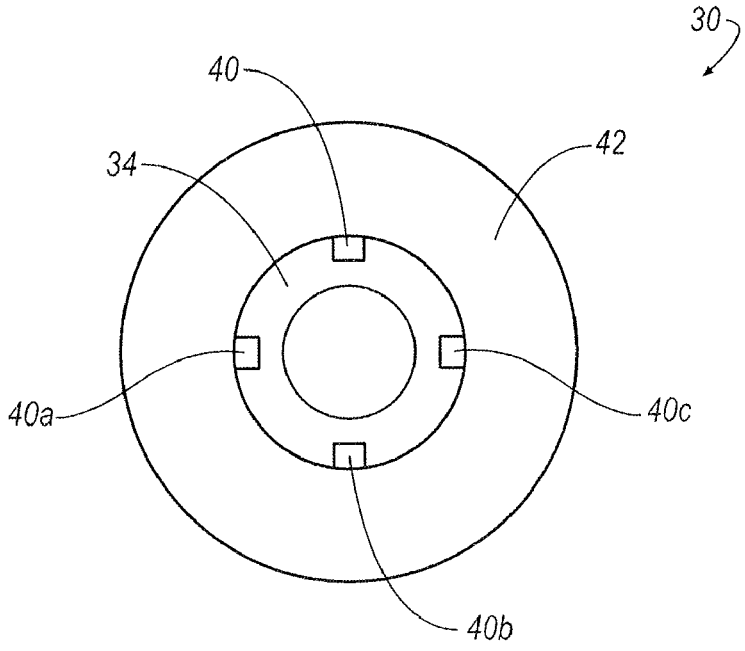
FIG. 5 is a rear view (bottom in FIG. 4) of the wear sleeve shown in FIG. 4.

A single axial slot 40 is shown in the shank 34 of the wear sleeve 30. FIG. 5 shows a rear view of another embodiment of a wear sleeve according to one embodiment of the present invention having additional axial slots 40*a*, 40*b*, 40*c* about the shank 34 of the wear sleeve 30. It should be appreciated that with the additional axial slots, 40*a*, 40*b*, 40*c*, may be rotated or indexed so that any of the axial slots would correspond to the radial slot 72 of the holder portion 24 and key 64 of the keyed ring. In another embodiment, other axial slots 40*a*, 40*b*, 40*c*, may be present and correspond to additional keys on the keyed ring 60 which also correspond to additional radial slots within the holder portion 24. In yet another embodiment, the wear sleeve 30 may have a single axial slot 40 and the keyed ring 60 may have a single key 64 while multiple radial slots are located within the holder portion 24. It should be noted that slots may extend partially or wholly through the holder portion or wear sleeve. It should further be noted that, although the rear view of the wear sleeve 30 shown in FIG. 5 shows a circular forward portion 32, the forward portion 32 may be any suitable shape.

Figure 6:
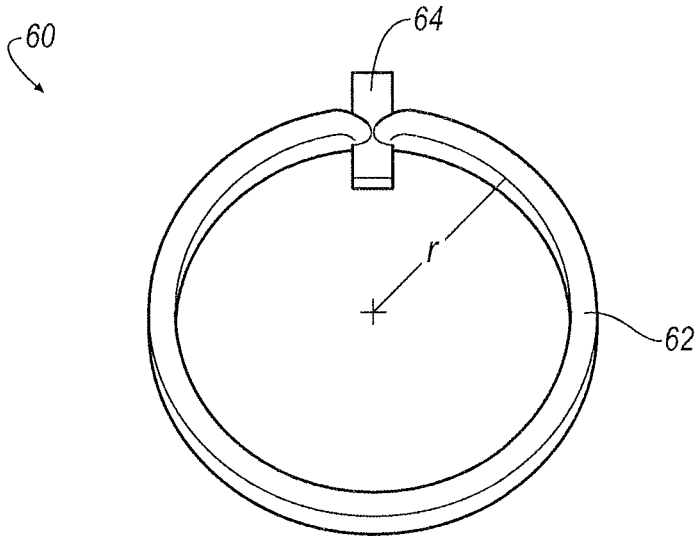
FIG. 6 is a keyed ring according to one embodiment of the present invention.

FIG. 6 illustrates a keyed ring 60 according to one embodiment of the present invention. The keyed ring 60 has a radius, r, dimensioned to allow the keyed ring 60 to pass over the shank 34 of a wear sleeve 30. Key 64 is dimensioned to fit within the axial slot of the wear sleeve 30 and the radial slot of the rear face 54 of the holder portion 24. As mentioned in the preceding paragraph, multiple keys may be located about the ring 62 to further secure the wear sleeve 30 from rotation or to accommodate other embodiments of the present invention.

Figure 7:
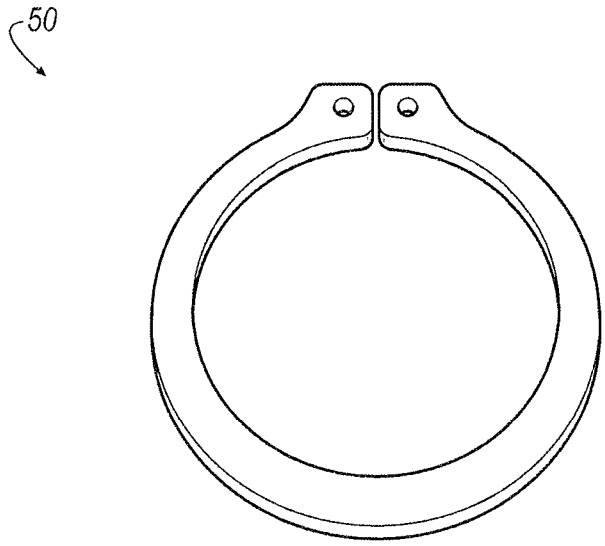
FIG. 7 is a split ring for retaining the wear sleeve according to one embodiment of the present invention.

FIG. 7 shows a retaining ring 50 according to one embodiment of the present invention. The retaining ring 50 may be a tapered section retaining ring as shown with lugs 52 at each end of the retaining ring 50. Ring pliers may be used to engage the lugs and expand the split ring 50 over the shank of the wear sleeve so the split ring 50 can be seated in the circumferential groove of the wear sleeve. Although a particular type of ring 50 is shown in FIG. 7 any suitable fastener may be used, e.g., other ring style or a threaded section with a nut.

Figure 8:
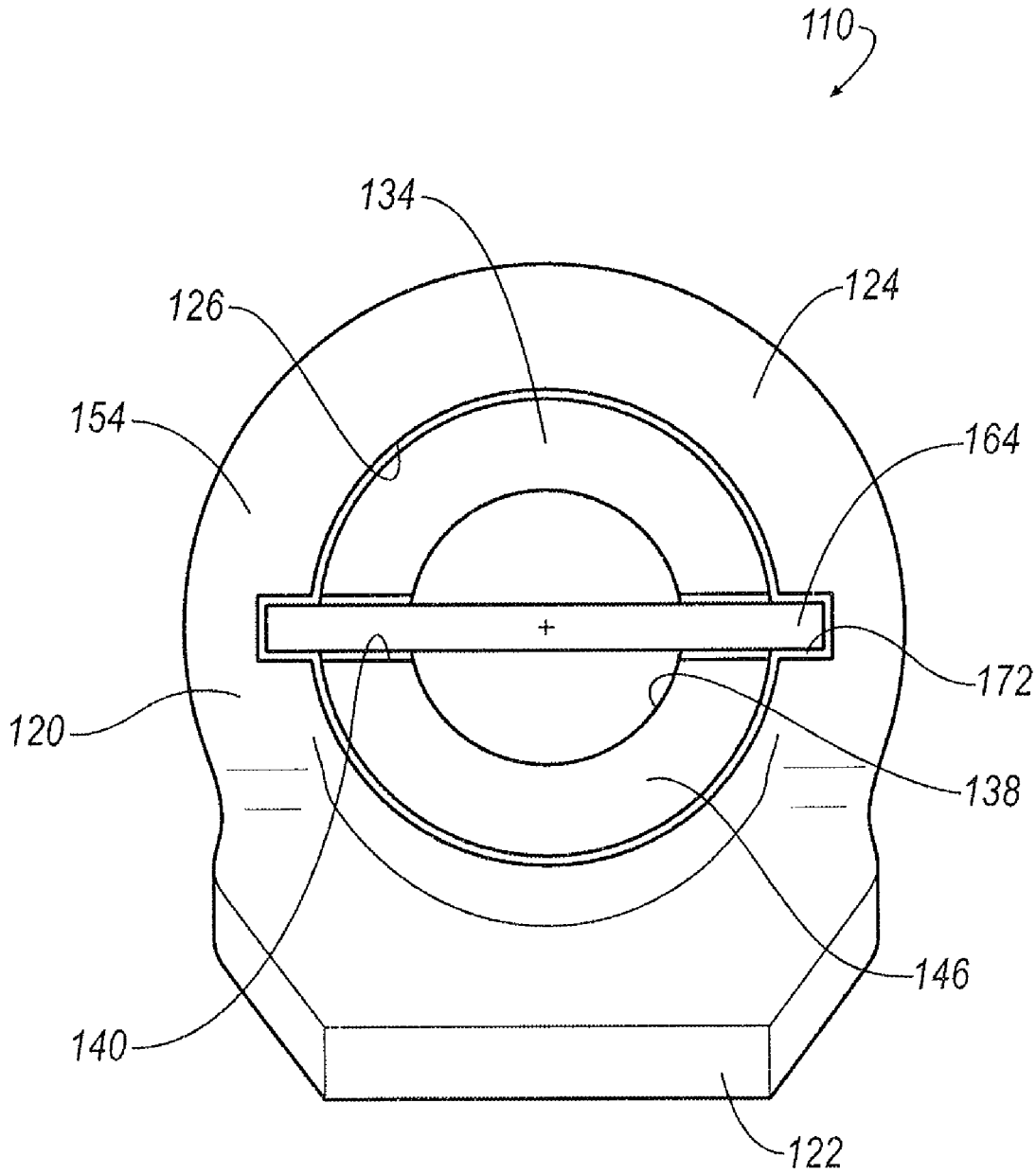
FIG. 8 is a rear view along the longitudinal axis of base assembly wherein a key traverses two opposing notches in the wear sleeve and two opposing notches in the block according to one embodiment of the present invention.
Figure 9:
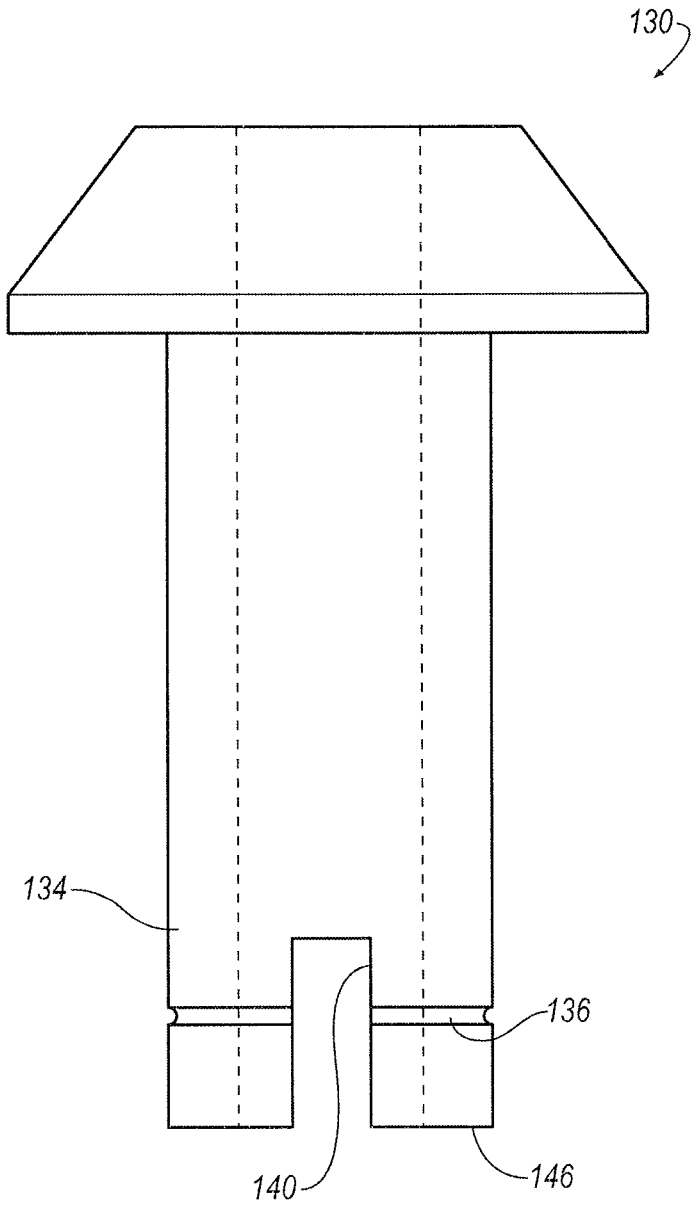
FIG. 9 is a side view of a wear sleeve utilized in the embodiment shown in FIG. 8.
Figure 10:
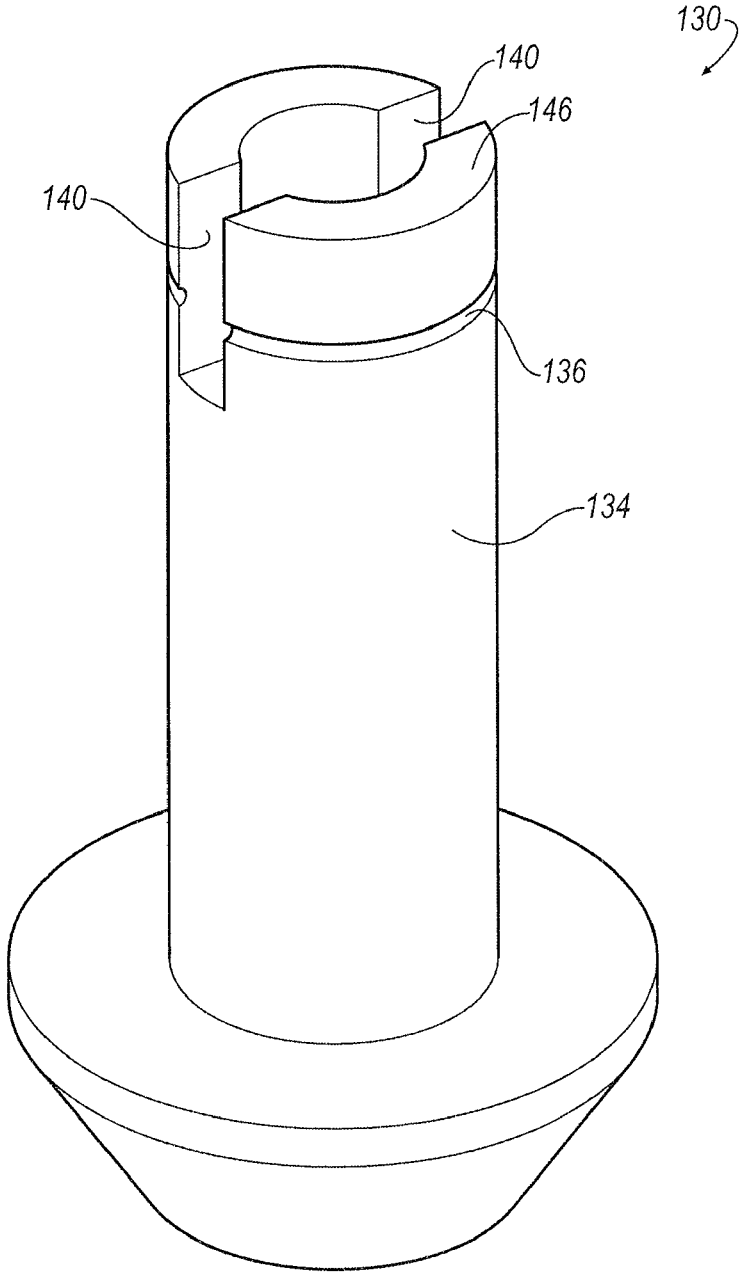
FIG. 10 is an isometric view of a wear sleeve utilized in the embodiment shown in FIG. 8.

FIGS. 8-10 show another embodiment of the present invention without a counterbore or ring recessed in the rear face of the holder portion. Referring now to FIG. 8, the base assembly 110 may include a block 120 with a holder portion 124 and a pedestal portion 122. As with earlier described embodiments, a shank 134 of a wear sleeve fits within the bore 126 and extends beyond the rear face 154 of the holder portion 124. In this embodiment, the key 164 spans across the notches 140 the rear end 146 of the shank 134 of the wear sleeve and extend into channels 172 of the holder portion 124. A circumferential groove 136 (shown in FIG. 9-10) about the shank 134 of the holder portion 124 provides a seating surface for installation of one or more retaining rings. The retaining rings retain the wear sleeve in the holder portion 124 and retain the key 164 in the notches 140 of the wear sleeve and channels 174 of the holder portion 124. FIGS. 9-10 show isolated views of the wear sleeve 130. Notches 140 extend beyond the circumferential groove 136 so that the retaining ring fits over the key 164. It should be appreciated, that other key, channel and notch configurations are possible.

Figure 11:
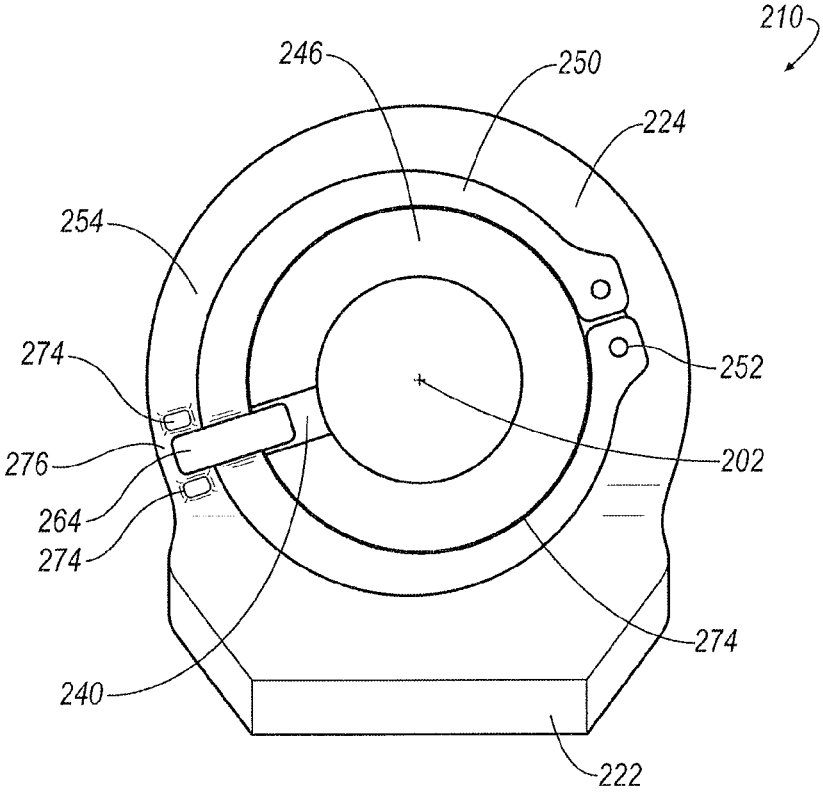
FIG. 11 is a rear view along the longitudinal axis of base assembly wherein a key traverses a notch in the block and a notch in the wear sleeve and wherein the key is attached to the retaining ring according to one embodiment of the present invention.
Figure 12:
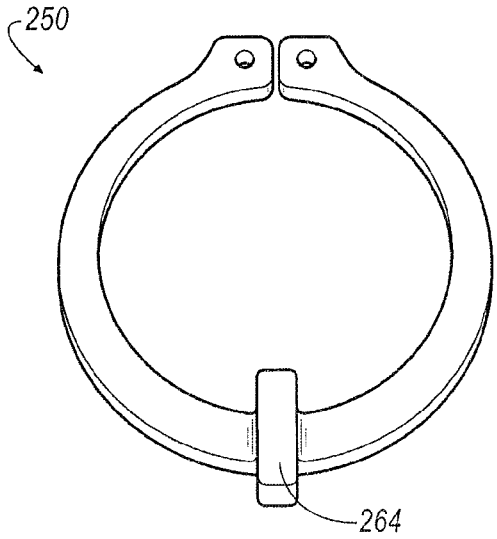
FIG. 12 is the retaining ring with attached key of FIG. 11.

Referring now to FIGS. 11-12, a rear view of a base assembly 210 is shown. In this embodiment, a key 264 is attached to the retaining ring 250. An additional keyed ring is not necessary. It is also not necessary to have a counterbore in the holder portion 224. The retaining ring 250 seats within a circumferential groove of the wear sleeve 246 (not shown in FIG. 11) at an axial position external to the bore of the holder portion 224. Wear sleeve 246 and holder portion 224 may be disposed about a longitudinal axis 2. In this embodiment, protrusions 274 extend from the rear face 254 to define a slot 276 between the protrusions 274. The key 264 extends from the wear sleeve notch 240 to the slot 276 defined by the protrusions 274. The protrusions 274 may be forged as an integral part of the holder portion or affixed in some other fashion known to those skilled in the art. Although no keyed ring is used in this embodiment, it should be appreciated that a combination with a keyed ring, protrusions, and retaining ring is also possible.

Whereas particular embodiments of this invention have been described above for purposes of illustration, it will be evident to those skilled in the art that numerous variations of the details of the present invention may be made without departing from the invention as defined in the appended claims.

The invention claimed is:

1. An apparatus for mounting a cutting tool used in mining and construction, comprising:

a block comprising a holder portion having a front face, a rear face and a bore through the holder portion having a longitudinal axis, the bore extending from the front face of the holder portion to the rear face of the holder portion, and the rear face of the holder portion having a radial slot formed therein;

a wear sleeve having a forward portion adjacent the front face of the holder portion and a shank extending through the bore of the holder portion, the shank having a rear end with at least one notch therein;

at least one key engaging the at least one slot of the holder portion and the at least one notch of the shank of the wear sleeve, thereby preventing rotational movement of the wear sleeve relative to the holder portion; and means for retaining the wear sleeve in the holder portion.

2. The apparatus for mounting a cutting tool of claim 1, further comprising a counterbore in the rear face of the holder portion which is concentric with the bore of the holder portion.

3. The apparatus for mounting a cutting tool of claim 2, further comprising a ring attached to the key, the ring being structured and arranged to fit in the counterbore.

4. The apparatus for mounting a cutting tool of claim 1, wherein the at least one key is rectangular.

5. The apparatus for mounting a cutting tool of claim 1, wherein the wear sleeve has a hole extending axially through the wear sleeve and disposed about the longitudinal axis.

6. The apparatus for mounting a cutting tool of claim 5, wherein the at least one notch in the shank of the wear sleeve extends from the hole of the wear sleeve to an exterior of the wear sleeve.

7. The apparatus for mounting a cutting tool of claim 1, wherein the front portion of the wear sleeve further comprises a tapered front surface and a shoulder which abuts the front face of the block.

8. The apparatus for mounting a cutting tool of claim 1, wherein the block further comprises a pedestal portion structured and arranged to mount the block on a drum or chain.

9. The apparatus for mounting a cutting tool of claim 1, wherein the at least one slot at the rear face of the holder portion extends radially from the interior surface of the bore to an exterior the holder portion.

10. An apparatus for mounting a cutting tool used in mining and construction, comprising:

a block comprising a holder portion having a front face, a rear face and a bore through the holder portion having a longitudinal axis, the bore extending from the front face of the holder portion to the rear face of the holder portion, and at least one slot at the rear face of the holder portion;

a wear sleeve having a forward portion adjacent the front face of the holder portion and a shank extending through the bore of the holder portion, the shank having a rear end with at least one notch therein;

at least one key engaging the at least one slot of the holder portion and the at least one notch of the shank of the wear sleeve, thereby preventing rotational movement of the wear sleeve relative to the holder portion;

means for retaining the wear sleeve in the holder portion;

a counterbore in the rear face of the holder portion which is concentric with the bore of the holder portion; and a ring attached to the key, the ring being structured and arranged to fit in the counterbore.

* * * * *